United States Patent [19]

Salomez

[11] Patent Number: 5,056,566

[45] Date of Patent: Oct. 15, 1991

[54] CONTROL OF WEFT INSERTION TIMING AS A FUNCTION OF SHED OPENING

[75] Inventor: Herman Salomez, Zonnebeke, Belgium

[73] Assignee: Picanol N.V. naamloze vennootschap, Belgium

[21] Appl. No.: 507,456

[22] Filed: Apr. 11, 1990

[30] Foreign Application Priority Data

Apr. 19, 1989 [BE] Belgium ..... 8900424

[51] Int. Cl.[5] ..... D03D 47/30

[52] U.S. Cl. ..... 139/452; 139/435.2; 139/435.5

[58] Field of Search ..... 139/450, 452, 436, 55.1, 139/435.1, 435.2, 435.5

[56] References Cited

U.S. PATENT DOCUMENTS 3,736,963 6/1973 Allison ..... 139/450 X
4,054,159 10/1977 Juillard ..... 139/450
4,534,387 8/1985 van Hest .
4,646,791 3/1987 Tsuji et al. .
4,673,004 6/1987 Rosseel et al. .
4,732,179 3/1988 Takegawa .
4,744,393 5/1988 Takegawa ..... 139/435.1
4,827,990 5/1989 Takegawa ..... 139/435.2
4,877,064 10/1989 Pezzoli ..... 139/452 X
4,901,770 2/1990 Takegawa ..... 137/435.2

*Primary Examiner*—Andrew M. Falik
*Attorney, Agent, or Firm*—Bacon & Thomas

[57] ABSTRACT

A method for supplying weft threads into the shed of a weaving machine includes the step of controlling at least one of the weaving machine elements which can influence weft insertion times as a function of the reopening of the shed. The method is particularly applicable to weaving machines of the type in which weft threads are inserted by a transport fluid. A device for carrying out the above method includes a computing unit and memory which controls an insertion time influencing element in response to signals related to a moving pattern of the harnesses and information regarding the weft pattern.

12 Claims, 2 Drawing Sheets

CONTROL OF WEFT INSERTION TIMING AS A FUNCTION OF SHED OPENING

BACKGROUND OF THE INVENTION

This invention concerns a method for supplying weft threads into the shed of a weaving machine, in particular of weaving machines of the type where weft threads are inserted in the shed by means of a transport fluid, and also a device which uses this method.

It is known that in weaving machines of this type, the relation between the insertion of a weft thread and the shed formation must meet two major conditions. The first condition is that the shed must be sufficiently opened and correct at the moment when the weft thread is inserted in the shed, in a way that it is impossible for the inserted weft thread and the warp threads to become entangled. A second major condition is that the weft thread must be kept taut in the shed before it is beaten up and before the shed is closed.

As known, the shed formation, i.e. the opening of the shed and the creation of a correct shed, depends on different factors. A first factor is the weave pattern, i.e. the moving pattern of the harnesses according to which different sheds are successively formed, and which are repeated per sequence.

Two other major factors which characterize the shed formation are the type of warp threads used and the warp count.

It is possible that during the shift of the harnesses, a number of warp threads will become temporarily entangled until the warp and in particular, the harnesses in question are sufficiently removed from each other again, thus keeping the warp threads taut. This possible entanglement depends on the two major factors listed above. This means, for example, that in a very regular weave pattern in which smooth warp threads are used, the shed will open very regularly, and the insertion of weft threads can start with a very small opening angle of the shed. In that case, the time available for the weft insertion is relatively long.

On the other hand, if the formed shed can only reopen itself with difficulty, meaning that the shed requires more time than usual to open itself sufficiently, which can imply a difference of 20 crank angles, the time available for the weft insertion is substantially shorter. Also, a higher weft insertion speed is required.

It is known that in weaving machines, a weft insertion never starts earlier than the moment when the moot difficult shed to be formed is sufficiently opened. If in a certain weave pattern, only one slowly opening shed occurs, the insertion of all weft threads will nevertheless therefore depend on the one slowly opening shed. This is disadvantageous in that a large number of weft threads are inserted at a higher speed than necessary, which increases the consumption of air. Moreover, most weft threads are put under a heavier strain than is strictly necessary during the weft insertion, which substantially increases the chance of weft breaks.

SUMMARY OF THE INVENTION

The present invention concerns a method for supplying weft threads into the shed of a weaving machine which does not have the foregoing disadvantages. Also, the invention concerns a method which can be used in particular for weaving machines of the type where weft threads are inserted in the shed by means of a transport fluid, wherein at least one of the elements of the weaving machine which can influence the weft insertion time is controlled as a function of the reopening of said shed, and preferably as a function of the moving pattern of the harnesses, in other words, as a function of the weave pattern.

According to a preferred embodiment, the method according to the invention implies that a weft insertion time influencing part of the weaving machine is controlled per weaving cycle in such a way that each weft insertion starts as soon as the shed concerned permits the insertion.

According to an especially preferred embodiment, at least one of the elements of the weaving machine which can influence the insertion time is controlled as a function of both the characteristics of the reopening of the shed and the type of weft thread to be inserted in the shed concerned, in other words, the weft pattern.

The present invention also concerns a device for a weaving machine, which uses the method of the invention.

BRIEF DESCRIPTION OF THE DRAWINGS

In order to explain the characteristics of the invention, by way of example only and without being limitative in any way, the following preferred embodiments are described with reference to the accompanying drawings, where.

DETAILED DESCRIPTION OF THE PREFERRED EMBODIMENTS

Figure 1:
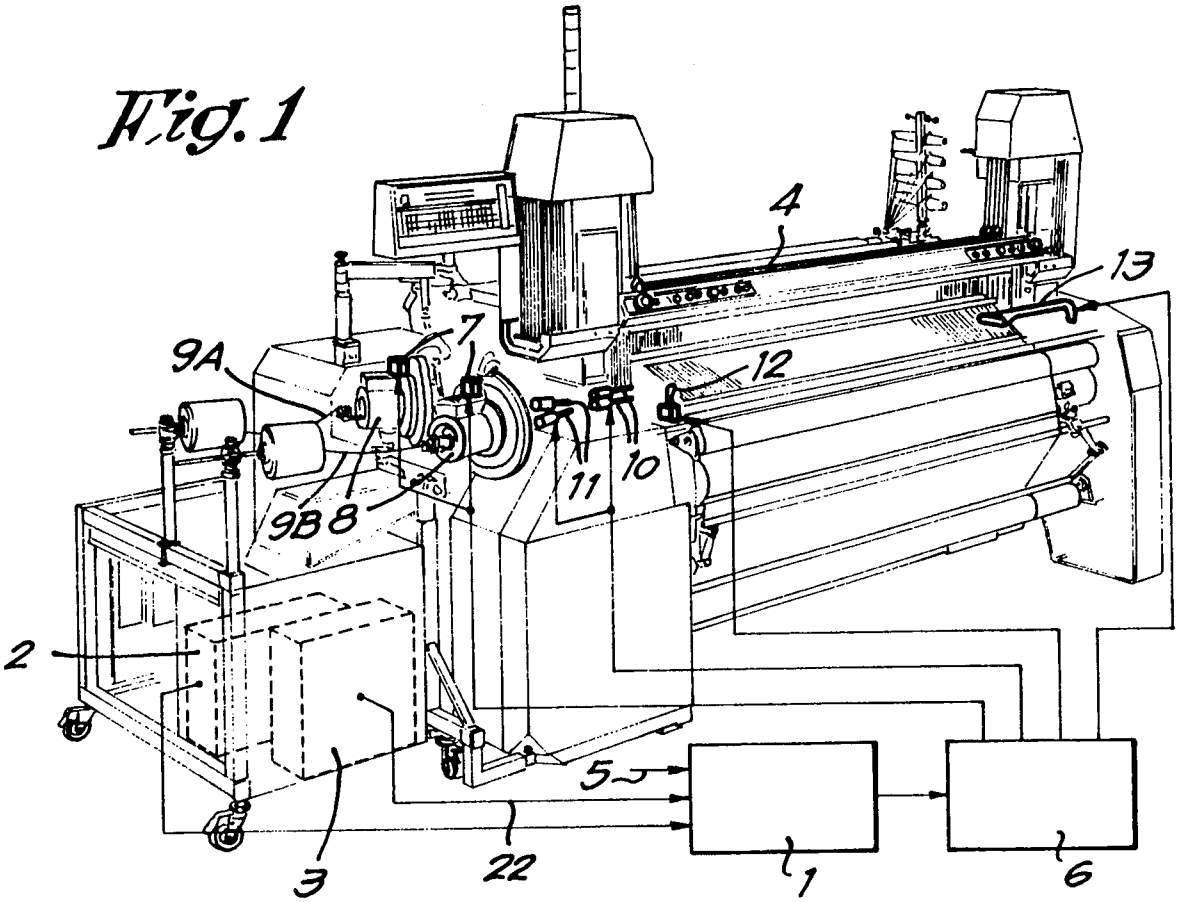
FIG. 1 is a perspective view of a weaving machine which uses the method and device according to the invention, including schematic diagrams of the controlling circuitry and shedding shed.

As shown in FIG. 1, the device according to the invention is includes the combination of a computing unit and memory 1 which receives input signals from the main drive 2 and/or the shedding mechanism 3 an entry 5 via which information regarding the relation between the weft pattern and the opening of the shed is transmitted, as well as information regarding the weft pattern, i.e. what sort of weft thread is to be inserted in which shed, and a control unit 6 coupled to the computing unit and memory 1, which controls the elements of the weaving machine which can influence the insertion times. The shedding mechanism 3, as is known, drives the harnesses 4. Insertion times means not only the time required for the insertion of a weft thread, but also the moments at which a weft insertion begins and ends.

The shedding mechanism 3 in itself is sufficiently known, and is only represented schematically. This shedding mechanism 3 may consist, for example, of a crank mechanism, a cam mechanism, or a dobby or jacquared mechanism which drives the harnesses 4 in an appropriate way.

FIG. 1 shows an airjet weaving machine. The elements of the machine which can influence the insertion times include as is known magnetically controlled pins 7 of the thread preparation devices 8 which command the supply of the weft threads 9A–9B, main nozzles 10, optional auxiliary main nozzles 11, relay nozzles 12, and means 13 to stretch the inserted weft threads 9A–9B, such as a blowing or suction nozzle.

Figure 2:
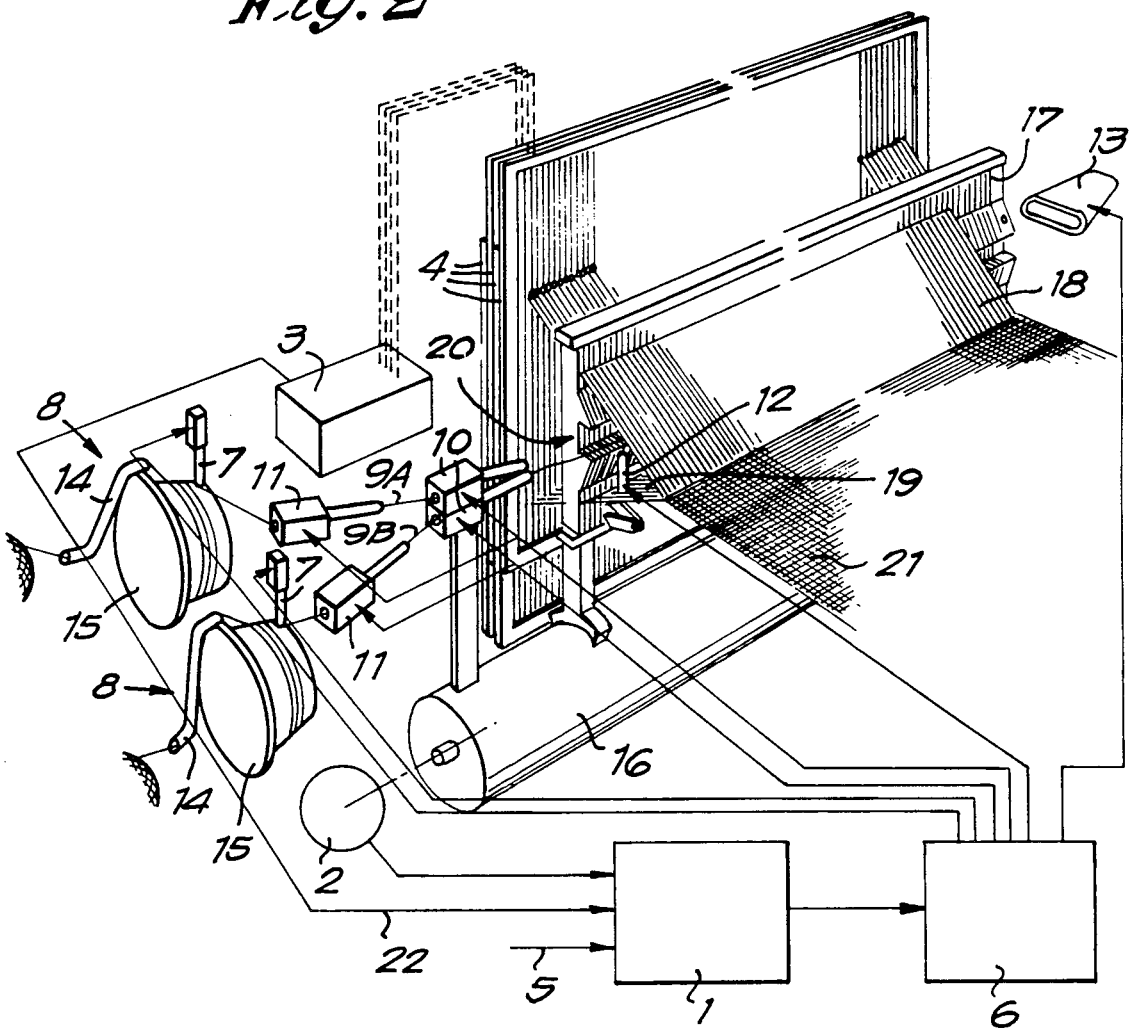
FIG. 2 is also a perspective view with schematically illustrated circuitry of the device according to the invention.

FIG. 2 shows the device according to the invention in greater detail. Apart from the parts mentioned above, it also shows the winding tubes 14 and the prewinder drum 15 of the thread preparation devices 8, the sley 16 with the reed 17, the upper shed 18, the lower shed 19, the shed 20 and the resulting cloth 21.

The method according to the invention preferably comprises the steps of controlling the machine elements which can influence the insertion times are as a function of the reopening of the shed concerned in such a way as a function of the moving pattern of the harnesses 4. This moving pattern determines which threads will be moved crosswise. In order to know which shed formation is next, the main shaft of the weaving machine includes a detector which follows the weaving cycles and which emits signals during each cycle to the computing unit and memory 1. The computing unit and memory includes means for following respective cycles on the basis of the signals and on the basis of a starting condition. With an electronically controlled shed formation mechanism 3, this signal 22 can be transmitted directly from this shed formation mechanism to the computing unit and memory 1.

Specific data regarding the opening time of every shed of the weave pattern are transferred to said entry 5. The data includes the moment at which the shed is correctly formed and the moment at which the insertion can start. This data can be determined in advance in various ways, either by experiment, if necessary by means of measurements inside the shed to check how the warp threads which are being crossed behave during the respective shed formations and in order to determine when the shed 20 is entirely free or optimally unentangled, or by deducing the opening of shed 20 from the sort of warp threads used, the weave pattern, etc. on the basis of a specially developed table. The data is inserted manually or by means of a memory module in the computing unit and memory 1.

On the basis of the opening time data, the computing unit and memory 1 determines which are the maximum available insertion times for the respective weaving cycles. In this way, the available weft times can be optimally used, and the weft threads 9A–9B can be inserted into the shed 20 with minimum load and a minimum air consumption. This means that, per weaving cyclus, the weft insertion can start as soon as the related shed 20 allows for it.

Moreover, the weaving machine elements should preferably in the above-described embodiments be controlled in such a way that all inserted lengths of weft thread reach the end of the sheds in their respective weaving cycles at the same moment.

According to another specific embodiment, at least one of the weaving machine elements which can influence the insertion times is to be controlled as a function of not only the characteristics of the reopening of the shed 20, but also as a function of the type of weft thread 9A–9B inserted in the related shed 20, or, in other words, the weft pattern. The data related to the weft pattern are also transferred via the entry 5 to the computing unit and memory 1.

The reason for control as a function of thread type is that it is actually possible, in two identical sheds formed at for different moments, different weft threads to be inserted. A different weft thread max behave differently towards the air jet which moves the weft thread. A hairy weft thread 9A, for example, is moved faster and easier by a particular well-known air jet than a smooth weft thread 9B moved by the same air jet, because the hairy weft thread 9A is carried along more easily than a smooth thread 9B.

As a result, if the insertion time is controlled as described above, the insertion of a hairy weft thread 9A will require less air consumption than the insertion of a smooth thread 9B, which results in savings on air consumption once again.

The present invention is in no way limited to the embodiments described and shown in the drawings; on the contrary, such a method for the insertion of weft threads into the shed of a weaving machine, as well as the device which uses such method, can be made in various variants while still remaining within the scope of the invention.

I claim:

1. A method of supplying weft threads to a shed of a weaving machine, said weaving machine including shed forming means for moving warp threads to form a shed, means for inserting weft threads into the shed by means of a transport fluid, and means for controlling timing of said insertion of weft threads into the shed, comprising the steps of opening the shed, inserting a weft thread into the shed by means of said insertion means, and controlling the insertion timing as a function of the pattern according to which different sheds are successively formed by said shed forming means to ensure the optimal use of an unentangled opening of the shed before weft insertion.

2. A method as claimed in claim 1, wherein said shed forming means comprises harnesses and said step of controlling the insertion timing comprises the step of controlling insertion timing as a function of a moving pattern of the harnesses.

3. A method as claimed in claim 1, wherein said step of controlling the insertion timing as the function of the opening of the shed comprises the step of controlling the insertion timing so that weft insertion starts as soon as the shed has been opened sufficiently for insertion to occur.

4. A method as claimed in claim 1, wherein said step of controlling the insertion timing comprises the step of controlling the insertion timing in such a way that the maximum weft insertion time available for a weaving cycle is used.

5. A method as claimed in claim 1, wherein said step of inserting the weft thread is repeated during a plurality of weaving cycles and said step of controlling the insertion timing is carried out in such a way that the weft thread reaches an end of the shed at the time during each weaving cycle.

6. A method as claimed in claim 1, further comprising the step of controlling said insertion means as a function of type of weft thread to be inserted into the shed.

7. A device for supplying weft threads to the shed of a weaving machine which includes insertion means for inserting weft threads into the shed by means of a transport fluid, means for influencing timing of said insertion of weft threads into the shed, and means including harnesses for opening and closing the shed, comprising a computing unit and memory, said computing unit including means to which signals related to a moving pattern of the harnesses and information regarding a weft pattern are transmitted, and to which data regarding a relation between the moving pattern of the harnesses and shed formation is transferred; and control means coupled to said computing unit and memory and responsive to said signals and data for controlling said insertion timing influence means to ensure the optimal use of an unentangled opening of the shed before weft insertion.

8. A device as claimed in claim 7, wherein said computing unit and memory are connected to a shed formation mechanism, and the shed formation mechanism includes means for emitting a signal which is a function of the moving pattern of the harnesses.

9. A device as claimed in claim 7, wherein said insertion means includes means for repeatedly inserting weft threads during a plurality of weaving cycles, said computing unit and memory is connected to a main shaft of the weaving machine, and said main shaft includes a detector which emits signals during each weaving cycle, said computing unit and memory including means for following respective weaving cycles on the basis of the signals and on the basis of a starting condition.

10. A device as claimed in claim 7, wherein said weaving machine is an air jet weaving machine and said insertion mean includes thread preparation devices comprising prewinders, the timing of insertion being controlled by means including pins for releasing and stopping release of weft threads from the thread preparation devices.

11. A device as claimed in claim 7, wherein said weaving machine is an air jet weaving machine, and wherein said insertion timing influencing means includes a main nozzle.

12. A device as claimed in claim 7, wherein said means for insertion timing influencing means includes a main nozzle, auxiliary main nozzles, relay nozzles, and means for stretching inserted weft threads.

* * * * *